US007378932B1

(12) United States Patent
Crow et al.

(10) Patent No.: US 7,378,932 B1
(45) Date of Patent: May 27, 2008

(54) REDUCED SIZE HIGH-FREQUENCY SURFACE-MOUNT CURRENT SENSE TRANSFORMER

(75) Inventors: David E. Crow, Parkton, MD (US); George G. Stokes, Jr., Marietta, GA (US); Ken Chen, Taipei Hsien (TW); Gary Lee, Taipei Hsien (TW)

(73) Assignee: Ice Components, Inc., Marietta, GA (US)

( * ) Notice: Subject to any disclaimer, the term of this patent is extended or adjusted under 35 U.S.C. 154(b) by 0 days.

(21) Appl. No.: 11/798,328

(22) Filed: May 11, 2007

(51) Int. Cl.
*H01F 27/30* (2006.01)
*H01F 27/24* (2006.01)

(52) U.S. Cl. ..... 336/208; 336/198; 336/83; 336/212

(58) Field of Classification Search ..... 336/212, 336/198, 208, 192, 83
See application file for complete search history.

(56) References Cited

U.S. PATENT DOCUMENTS 3,947,796 A * 3/1976 Postma et al. ..... 336/192
4,200,853 A 4/1980 de Jong et al.
4,931,761 A * 6/1990 Kijima ..... 336/160
4,939,494 A 7/1990 Masuda et al.
5,182,536 A 1/1993 Boylan et al.
5,345,670 A 9/1994 Pitzele et al.
5,812,045 A * 9/1998 Ishikawa et al. ..... 336/83
6,072,380 A 6/2000 Monroe
6,507,261 B1 1/2003 Haga et al.
6,771,156 B2 * 8/2004 Chou ..... 336/83
7,268,857 B2 * 9/2007 Hua-Tang et al. ..... 356/4.01

FOREIGN PATENT DOCUMENTS

JP 04039910 A * 2/1992

* cited by examiner

*Primary Examiner*—Anh T Mai
(74) *Attorney, Agent, or Firm*—McDermott Will & Emery LLP

(57) ABSTRACT

A current sense transformer is provided for which includes a bobbin; the bobbin includes a winding portion for supporting a coil of wire. The winding portion includes a horizontal substantially flat base portion, a horizontal substantially flat top portion and a step portion. The step portion is disposed on top of the horizontal substantially flat base portion. The horizontal substantially flat top portion is disposed on top of the step portion substantially in parallel to the horizontal substantially flat base portion. The top portion has a central recess, raised portions on its upper surface separated from each other, and a ridge on one side of its lower surface. The central recess and the raised portions cooperate to accept a magnetic core, such that the core is substantially flush with the raised portions.

17 Claims, 6 Drawing Sheets

REDUCED SIZE HIGH-FREQUENCY SURFACE-MOUNT CURRENT SENSE TRANSFORMER

FIELD OF THE INVENTION

The present invention relates to a current sense transformer. The present invention has particular applicability to high-frequency switch-mode power supplies with operating frequencies greater than 100 kiloHertz (kHz).

BACKGROUND ART

Current sense transformers are used to measure current passing through a conductor. Typical applications for current sense transformers are overload sensing, load variation sensing, and electric power metering. The construction of a current sense transformer depends on the desired transformer efficiency, which in turn is dictated by the requirements of the application that uses the current sense transformer.

Current sense transformers that are required to be optimized to work at a very high efficiency typically employ a toroidal winding wherein the secondary winding is wound around a transformer core. These toroidal winding type current sense transformers are expensive to fabricate and therefore not practical for use in applications where transformer efficiency is not critical. Bobbin-wound current sense transformers are less expensive to fabricate than wound core devices, and transformer windings obtained from a simple bobbin machine can be used for these bobbin-wound current sense transformers.

A typical bobbin-wound current sense transformer has a laminated or ferrite core, a primary winding that has a single turn (or small number of turns) and a secondary winding with a large number of turns. The primary and secondary windings are mounted on the core and there are separate primary and secondary terminals connected to the primary and secondary windings respectively. Insulating members separate the primary winding, secondary winding and the core from one another.

During operation a typical current sense transformer has its primary winding connected in series with an alternating current source to be monitored. This current is coupled magnetically by the magnetic core shared by the primary and secondary windings. The current is reduced by the ratio of secondary to primary turns. A resistor is connected across the secondary winding so that the reduced current will flow through the winding and develop a voltage across the resistor. The voltage is dependent upon the value of the resistor connected across the secondary, and the amount of current flowing through the secondary.

The current trend in the electronics industry is to fabricate circuit boards smaller and smaller. As a result, there exists a need for an apparatus and methodology for a reduced size high-frequency surface-mount current sense transformer. There also exists a need for an apparatus and methodology for a current sense transformer with a greater voltage withstand capability.

SUMMARY OF THE INVENTION

An advantage of the present invention is a reduced size high-frequency surface-mount current sense transformer which includes a bobbin having a winding portion for supporting a coil of wire. The winding portion includes a horizontal substantially flat base portion, a horizontal substantially flat top portion and a step portion. The step portion is disposed on top of the horizontal substantially flat base portion. The horizontal substantially flat top portion is disposed on top of the step portion substantially in parallel to the horizontal substantially flat base portion. The top portion has a central recess, raised portions on its upper surface separated from each other, and a ridge on one side of its lower surface. The central recess and the raised portions cooperate to accept a magnetic core, such that the core is substantially flush with the raised portions. The base portion has a central recess, raised portions on its lower surface separated from each other. The central recess and the raised portions cooperate to accept a magnetic core, such that the core is substantially flush with the raised portions. Additional advantages and other features of the present invention will be set forth in part in the description which follows and in part will become apparent to those having ordinary skill in the art upon examination of the following or may be learned from the practice of the invention. The advantages of the invention may be realized and obtained as particularly pointed out in the appended claims.

Additional advantages of the present invention will become readily apparent to those skilled in this art from the following detailed description, wherein only an exemplary embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF THE INVENTION

Figure 1:
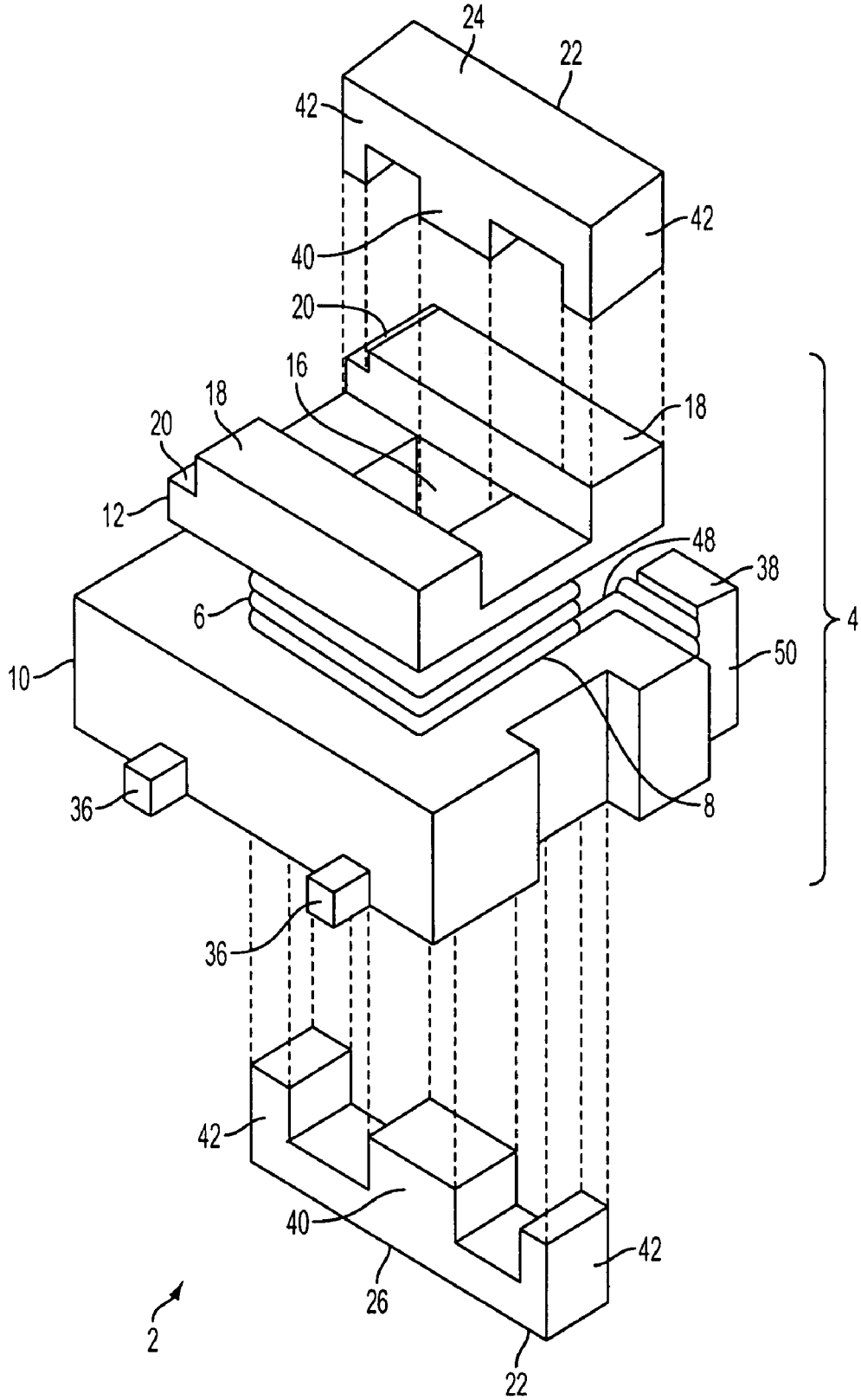
FIG. 1 is an exploded perspective view of a transformer according to an embodiment of the present invention.
Figure 2:
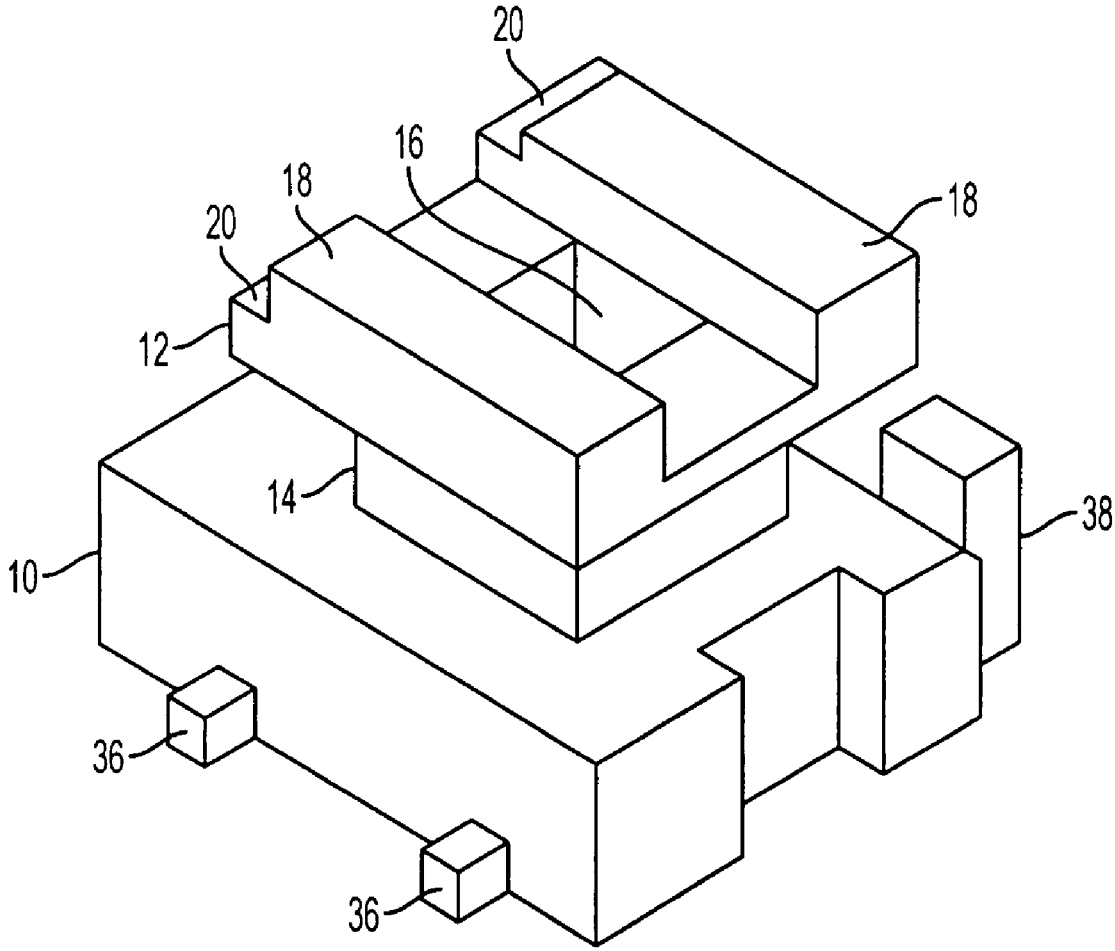
FIG. 2 is an exploded perspective view of the transformer of FIG. 1 with the core portion not shown.
Figure 3:
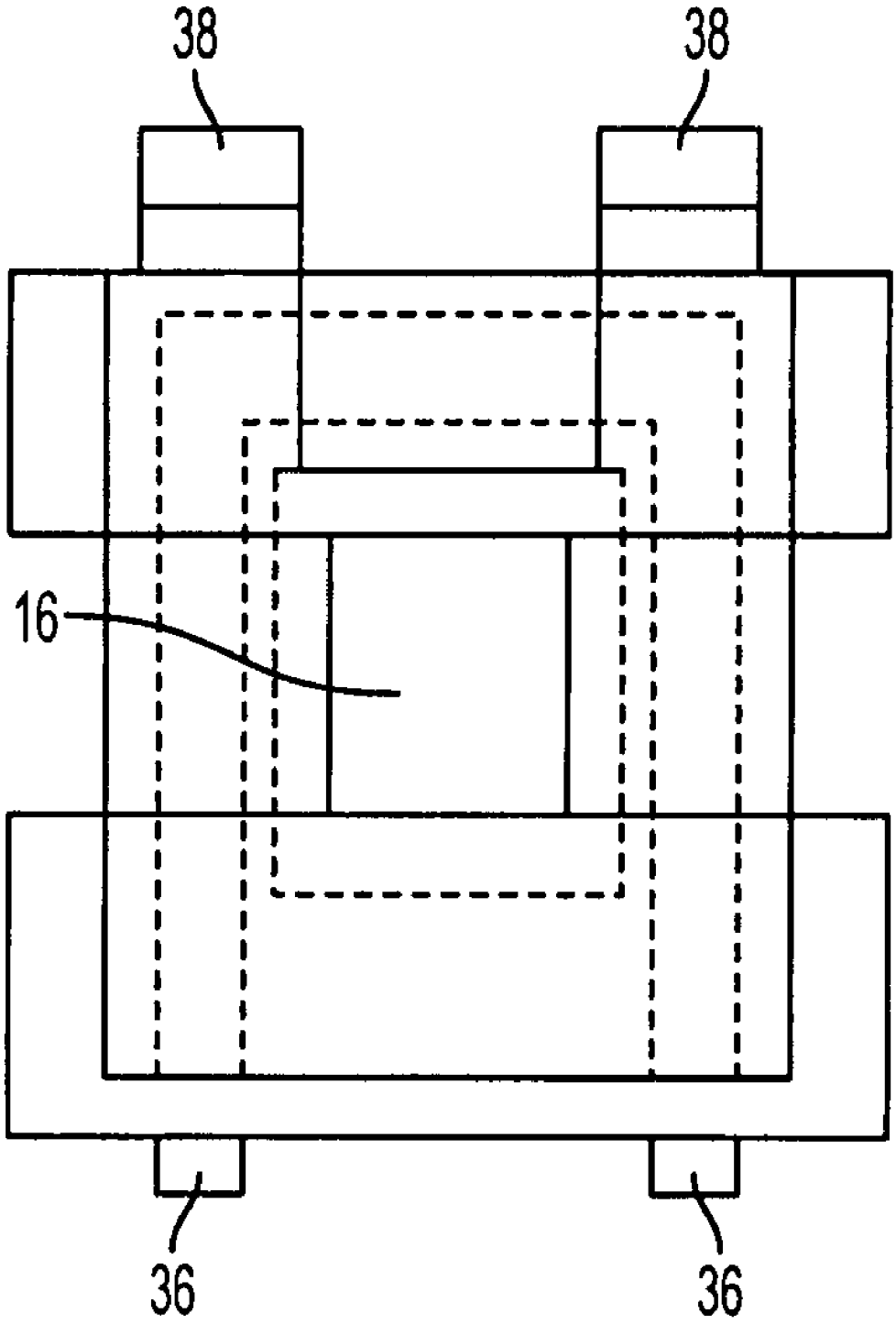
FIG. 3 is a top view of the transformer of FIG. 1 with the core portion not shown.

The present invention will now be described in detail with reference to FIGS. 1-6. Transformer 2 comprises a bobbin 4. The bobbin 4 comprises a thermoset resin. The bobbin 4 includes a winding portion 6 for supporting a coil of wire 8. The winding portion 6 includes a horizontal substantially flat base portion 10, a horizontal substantially flat top portion 12 and a step portion 14 (see FIG. 2). The step portion 14 is disposed on top of the horizontal substantially flat base portion 10. The horizontal substantially flat top portion 12 is disposed on top of the step portion 14 and is substantially in parallel to the horizontal substantially flat base portion 10. The peripheral dimensions of the top portion 44 are smaller than the peripheral dimensions of the base portion 46 (See FIG. 4). Additionally, the base portion 10 has a thickness T1 greater than the thickness T2 of the top portion 12. The present invention is about 65% of the size of currently available current sense transformers. This embodiment of the present invention has overall dimensions of 6.2 mm (L)×6.0 mm (W)×4.6 mm (H).

Figure 6:
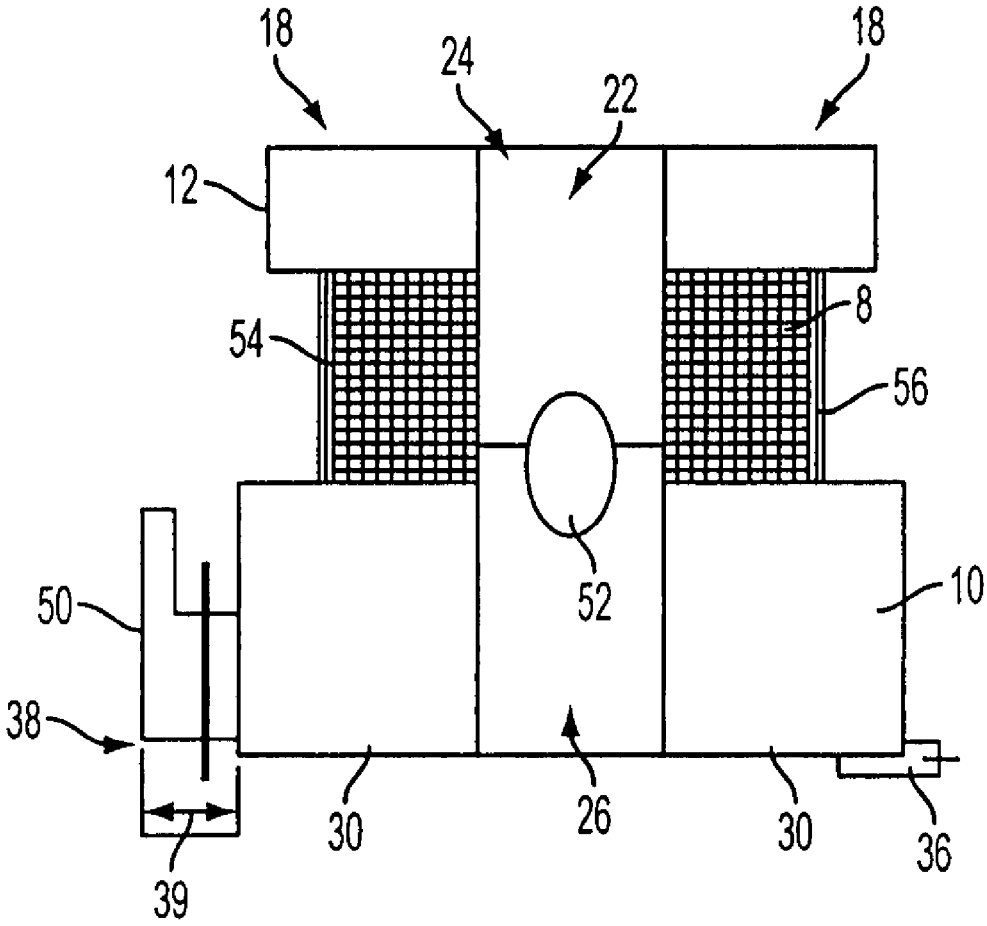
FIG. 6 is a side view of the transformer of FIG. 1.

The top portion 12 has a central recess 16, raised portions 18 on its upper surface separated from each other, and a ridge 20 on one side of its lower surface. The central recess 16 and the raised portions 18 cooperate to accept a magnetic core 22, such that the core 22 is substantially flush with the raised portions 18, as shown in FIG. 6. The magnetic core 22 comprises a top portion 24 and a bottom portion 26 which are employed for constituting a closed magnetic circuit. The core segments 24, 26 can comprise a conventional ferrite material with a magnetic permeability between 2,000 and 15,000 μi.

The base portion 10 has a central recess 28 (shown in FIG. 5), raised portions 30 on its lower surface separated from each other. The central recess 28 and the raised portions 30 cooperate to accept the bottom portion of the magnetic core 26, such that the bottom portion of the core 26 is substantially flush with the raised portions 30. The upper portion 24 and lower portion 26 of the E-shaped transformer core segments each have a center leg 40 and two end legs 42. The center leg 40 of the upper portion 24 of the core segment 22 is inserted into the central recess 16 of the upper portion 24 and the center leg 40 of the lower portion 26 of the core segment 22 is inserted into the central recess 28 of the base portion 10. The respective end legs of the upper core segment 24 are attached to the corresponding end legs of the lower core segment 26 by an adhesive material 52. The adhesive material 52 comprises a conventional epoxy resin.

Figure 4:
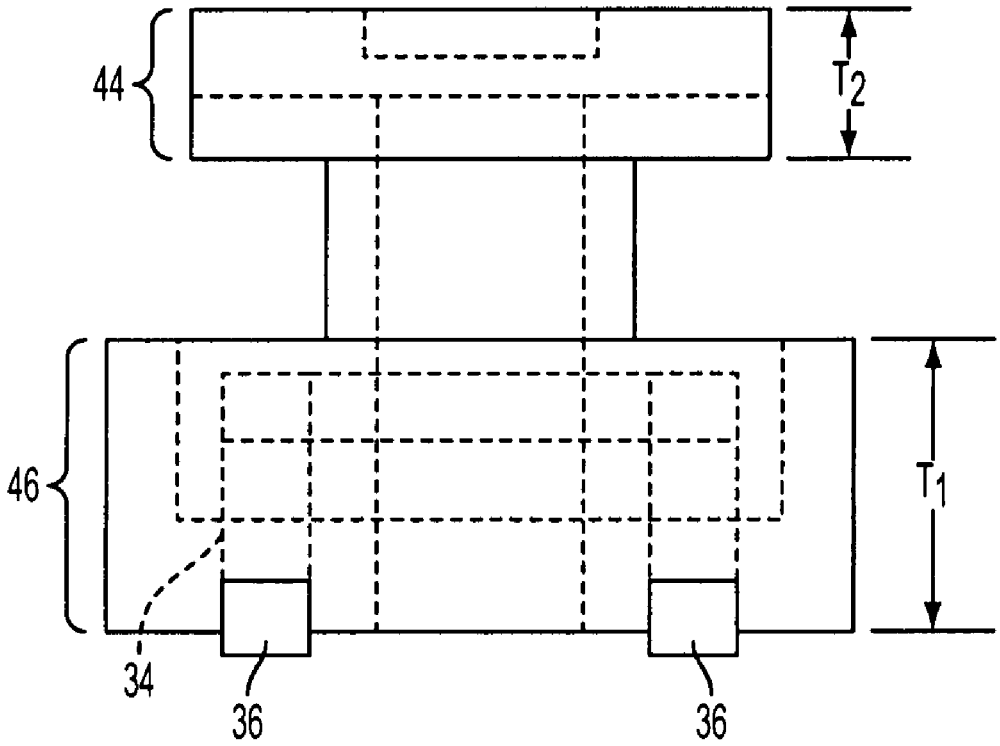
FIG. 4 is a front view of the transformer of FIG. 1 with the core portion not shown.
Figure 5:
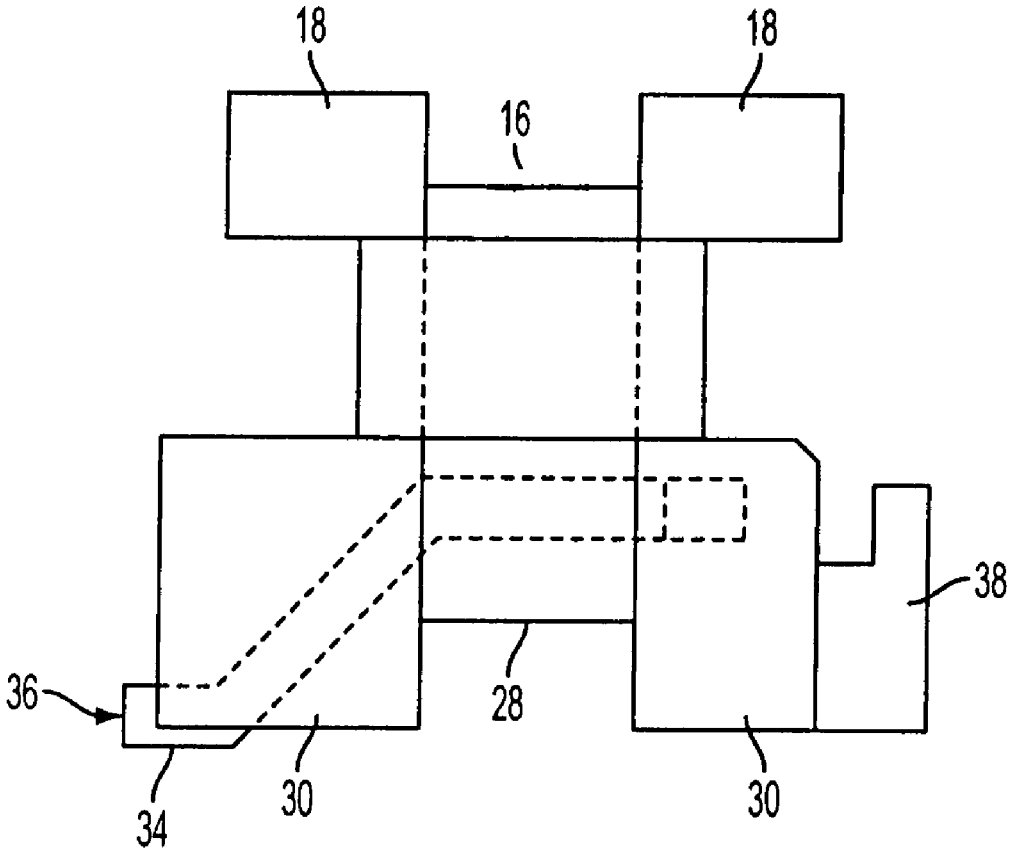
FIG. 5 is a side view of the transformer of FIG. 1 with the core portion not shown.

The bobbin includes a U-shaped first winding 34, as shown in FIGS. 4 and 5, embedded in the base portion 10 such that the ends of the first winding 34 are exposed to form a first pair of terminals 36. The first winding 34 consists of an electrically pure copper with an electrically conductive coating, as will be familiar to those skilled in the art. The ends of the first winding 34 protrude from the bobbin 4 and are formed in such a way as to create contacts for electrical connection to the printed circuit board.

The flat base portion 10 includes posts 38 (See FIGS. 1, 5 and 6) extending laterally from the base portion 10 for accepting the ends of the coil of wire 8. The ends of the coil of wire 48 are wrapped around the posts 38 to form a second pair of terminals 50. The coil of wire 8 comprises circular magnet wire 54. The coil of wire 8 is covered with conventional electronics grade insulating tape 56. The wire-wrapped posts 39 are dipped into molten solder to remove the electronics grade insulating tape 56, yielding a second pair of terminals 50 (See FIGS. 1 and 6).

Creepage Distance is defined as the shortest path between two conductive parts (or between a conductive part and the bounding surface of the equipment) measured along the surface of the insulation. A proper and adequate creepage distance protects against tracking, a process that produces a partially conducting path of localized deterioration on the surface of an insulating material as a result of the electric discharges on or close to an insulation surface. The degree of tracking required depends on two major factors: the comparative tracking index (CTI) of the material and the degree of pollution in the environment. Used for electrical insulating materials, the CTI provides a numerical value of the voltage that will cause failure by tracking during standard testing. Tracking that damages the insulating material normally occurs because of one or more of the following reasons: humidity in the atmosphere, presence of contamination, corrosive chemicals and altitude at which equipment is to be operated. The creepage distance between the first pair of terminals 36 and the coil of wire 8 of the embodiment of FIGS. 1-6 is 1.4 mm or larger.

Clearance Distance is defined as the shortest distance between two conductive parts (or between a conductive part and the bounding surface of the equipment) measured through air. Clearance distance helps prevent dielectric breakdown between electrodes caused by the ionization of air. The dielectric breakdown level is further influenced by relative humidity, temperature, degree of pollution in the environment, and altitude at which the equipment is to be operated. The distance through insulation between the first winding 34 and the coil of wire 8 of the embodiment of FIGS. 1-6 is between 0.25 mm and 1.1 mm or greater. The distance through the electronics grade insulating tape 56 between the first pair of terminals 36 and the coil of wire 8 is between 0.25 mm and 1.1 mm.

A working voltage is the highest voltage to which the insulation under consideration is (or can be) subjected when the equipment is operating at its rated voltage under normal use conditions. The following factors must be considered: determination of working voltages, pollution degree of the environment, and the overvoltage category of the equipment's power source. When measuring working voltages, it is important to measure both peak and root-mean-square (rms) voltages. The peak value is used to determine the clearance, and the rms value is used to calculate creepage. The voltage withstand capacity from the primary winding to the secondary winding determines which circuits can use the device. A typical current sense transformer of this size has a voltage withstand capability of 500 Volts, rms. The transformer of the present invention has a voltage withstand capability of 1,500 Volts, direct current.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A transformer comprising a bobbin including a winding portion for supporting a coil of wire, the winding portion including:

a horizontal substantially flat base portion;

a horizontal substantially flat top portion; and a step portion, wherein the step portion is disposed on top of the horizontal substantially flat base portion, and the horizontal substantially flat top portion is disposed on top of the step portion substantially in parallel to the horizontal substantially flat base portion, wherein the top portion has a central recess, raised portions on its upper surface separated from each other, and a ridge on one side of its lower surface, wherein the central recess and the raised portions cooperate to accept a magnetic core, such that the core is substantially flush with the raised portions;

wherein the base portion has a central recess, raised portions on its lower surface separated from each other, wherein the central recess and the raised portions cooperate to accept a magnetic core, such that the core is substantially flush with the raised portions.

2. The transformer of claim 1, wherein the bobbin includes a U-shaped first winding embedded in the base portion such that the ends of the first winding are exposed to form a first pair of terminals.

3. The transformer of claim 2, wherein the flat base portion includes posts extending laterally from the base portion for accepting the ends of the coil of wire.

4. The transformer of claim 3, wherein the ends of the coil of wire are wrapped around the posts to form a second pair of terminals.

5. The transformer of claim 4, wherein a creepage distance between the first and second pairs of terminals is 1.4 mm or larger.

6. The transformer of claim 2, wherein a creepage distance between the first pair of terminals and the coil of wire is 1.4 mm or larger.

7. The transformer of claim 2, wherein the distance through insulation between the first pair of terminals and the coil of wire is between 0.25 mm and 1.1 mm.

8. The transformer of claim 2, wherein the distance through insulation between the first winding and the coil of wire is between 0.25 mm and 1.1 mm or greater.

9. The transformer of claim 2, wherein the first winding consists of an electrically pure copper with an electrically conductive coating.

10. The transformer of claim 1 comprising first and second E-shaped transformer core segments each having a center leg and two end legs, wherein the center leg of the first core segment is inserted into the central recess of the top portion and the center leg of the second core segment is inserted into the central recess of the base portion.

11. The transformer of claim 1, wherein the peripheral dimensions of the top portion are smaller than the peripheral dimensions of the base portion, and the base portion has a thickness greater than the top portion.

12. The transformer of claim 10, wherein the respective end legs of one core segment are attached to corresponding end legs of the other core segment by an adhesive material.

13. The transformer of claim 12, wherein the adhesive material comprises an epoxy resin.

14. The transformer of claim 1, wherein the coil of wire comprises circular magnet wire.

15. The transformer of claim 14, wherein the coil of wire is covered with electronics grade insulating tape.

16. The transformer of claim 1, wherein the bobbin comprises a thermoset resin.

17. The transformer of claim 1, wherein the core segments comprise ferrite material with a permeability between 2,000 and 15,000 μi.

* * * * *